US008448383B2

(12) United States Patent
Bode

(10) Patent No.: US 8,448,383 B2
(45) Date of Patent: May 28, 2013

(54) DOOR DRIVE FOR A SWING DOOR OF A PASSENGER TRANSPORT VEHICLE

(75) Inventor: Christian Bode, Kassel (DE)

(73) Assignee: Tempora s.r.l., Lanciano (Chieti) (IT)

( * ) Notice: Subject to any disclaimer, the term of this patent is extended or adjusted under 35 U.S.C. 154(b) by 128 days.

(21) Appl. No.: 12/904,374

(22) Filed: Oct. 14, 2010

(65) Prior Publication Data

US 2011/0120018 A1 May 26, 2011

(30) Foreign Application Priority Data

Nov. 20, 2009 (DE) ..... 10 2009 053 991

(51) Int. Cl.
*E05F 15/12* (2006.01)

(52) U.S. Cl.
USPC ..... 49/334; 49/341

(58) Field of Classification Search
USPC ..... 49/324, 339, 340, 341, 345, 334
See application file for complete search history.

(56) References Cited

U.S. PATENT DOCUMENTS

| | | | | | |
|---|---|---|---|---|---|
| 4,308,691 | A * | 1/1982 | Horn | 49/255 |
| 4,472,908 | A * | 9/1984 | Wanzl et al. | 49/25 |
| 4,545,149 | A * | 10/1985 | Jentsch | 49/255 |
| 4,731,886 | A * | 3/1988 | Heinrich et al. | 49/334 |
| 4,833,827 | A * | 5/1989 | Bode et al. | 49/280 |
| 4,838,102 | A * | 6/1989 | Bode et al. | 74/424.75 |
| 4,924,625 | A * | 5/1990 | Dilcher | 49/212 |
| 5,263,280 | A * | 11/1993 | Dilcher | 49/212 |
| 5,373,664 | A * | 12/1994 | Butler | 49/358 |
| 6,141,908 | A * | 11/2000 | Bowen | 49/281 |
| 6,553,717 | B2 * | 4/2003 | St. John et al. | 49/340 |
| 6,925,684 | B2 * | 8/2005 | Kang et al. | 16/264 |
| 6,948,765 | B2 * | 9/2005 | Tong et al. | 296/146.4 |
| 7,210,268 | B2 * | 5/2007 | Tong et al | 49/255 |
| 7,367,161 | B1 * | 5/2008 | Jones | 49/334 |
| 2002/0092236 | A1 * | 7/2002 | Heffner et al. | 49/324 |
| 2003/0005639 | A1 * | 1/2003 | Kowalczyk | 49/340 |
| 2004/0244293 | A1 * | 12/2004 | Eckel et al. | 49/334 |
| 2007/0214724 | A1 * | 9/2007 | Tong et al. | 49/322 |
| 2008/0229666 | A1 * | 9/2008 | Jones | 49/334 |

FOREIGN PATENT DOCUMENTS

| | | |
|---|---|---|
| DE | 3742279 A1 | 7/1989 |
| DE | 4133179 A1 | 4/1993 |
| DE | 202007015770 U1 | 3/2009 |

* cited by examiner

*Primary Examiner* — Katherine Mitchell
*Assistant Examiner* — Justin Rephann
(74) *Attorney, Agent, or Firm* — Gifford, Krass, Sprinkle, Anderson & Citkowski, P.C.

(57) ABSTRACT

The subject of the invention is a door drive for a swing door of a passenger transport vehicle, comprising a rotary post, which is arranged at the vehicle, with at least one pivot arm for arrangement at a door leaf, wherein a motor is arranged in the rotary post and is connected with the rotary post, wherein at least one planetary transmission stage is provided for stepping down the rotational speed of the motor and wherein the pinion cage of the at least one planetary transmission stage comprises a rotary element, particularly a pinion, which is fixable.

11 Claims, 3 Drawing Sheets

DOOR DRIVE FOR A SWING DOOR OF A PASSENGER TRANSPORT VEHICLE

CROSS-REFERENCE TO RELATED APPLICATION

This application claims priority of German Patent Application DE 10 2009 053 911.3 filed Nov. 20, 2009.

FIELD OF THE INVENTION

The invention relates to a door drive for a swing door of a passenger transport vehicle.

BACKGROUND OF THE INVENTION

The most diverse kinds of swing doors are known from the prior art. On the one hand, in this connection swing-sliding doors are known which are described in, for example, DE 37 42 279 C2 and DE 41 33 179 A1.

In addition, pure pivot doors are known, wherein according to the prior art such swing doors are distinguished by the fact that these swing doors have, inter alia, a rotary post, a spindle drive which converts a stroke motion into a rotary motion being provided in the rotary post. In this regard, a head plate is provided, wherein the head plate receives a drive cylinder, the head plate being arranged at the top in the door portal and to that extent the height of the door passage itself being restricted. In this connection, a further door drive is known which is similarly based on a spindle drive, wherein in this door drive in order to fix the door leaf in the closed position the door drive at the end of the closing movement executes a vertical movement which ensures that the door leaf runs into wedge-shaped locking elements arranged at the door portal.

The above-described spindle drives are entirely pneumatically actuable by way of piston-cylinder drives, wherein, however, an electric door drive is also known from the prior art, such an electric door drive being arranged in the region of the boarding step of the vehicle. The arrangement of such a motor in the region of the boarding step obviously restricts the entry width of the door portal, which is disadvantageous particularly when, for example, a ramp for wheelchair users has to be arranged in the region of such a door entry.

In summary, it is therefore to be emphasised that in the case of door drives for swing doors of passenger transport vehicles such as, for example, buses, there is always the consequence of an increased need for space either in the roof region or the floor region of the portal due to the drive device, be it a pneumatic drive or an electric drive, which leads to restrictions in the passage height or in the width of the passage opening.

To that extent a drive device for a door of a vehicle of public passenger services with a rotary post drive is known from DE 20 2007 015 770 U1, wherein both the drive motor and the transmission are accommodated in the rotary post. In addition, a brake is accommodated in the rotary post, the brake being moved into the blocking setting under the action of the force of a spring. Release of the brake can be carried out electromagnetically or mechanically, this not being described in more detail.

SUMMARY OF THE INVENTION

The object of the invention accordingly consists of ensuring, in the case of a door drive with a drive motor—which is arranged in the rotary post—with downstream planetary transmission, unlocking in simple manner so that in the event of an emergency the door leaf can be manually transferred from the closed setting to the open setting.

This object is fulfilled by the features recited in claim 1.

At least one planetary transmissions stage is provided to step down the speed of rotary movement of the electric motor in the rotary post. Taking place through the at least one planetary transmission stage is, as already indicated, stepping down of the rotational speed of the motor with the consequence that torque then increases. It is thus possible to use comparatively small motors, wherein in addition depending on the number of planetary transmission stages employed it is possible to achieve self-locking of the door drive of such a kind that special measures with respect to unintended opening of the door during travel in the case of, for example, vibrations can be avoided.

As already mentioned above, the pinion cage of the at least one planetary transmission stage comprises a rotary element, particularly in the form of a pinion, which is fixable. If the pinion is not fixed, the pinion cage of the at least one planetary transmission stage can freely rotate. This means that the planets arranged at the pinion cage similarly freely rotate about the sun wheel which is arranged on the drive shaft of the electric motor. The rotary post is provided with an internal toothing in the region of the planets of the planetary transmission stage. If the rotary element, and here particularly the pinion, is now fixed, then rotational movement of the pinion cage is obviously precluded. This means that during operation of the motor, since the sun wheel is blocked and consequently the drive shaft of the motor is blocked, the rotary post itself is set in rotation by way of the connection of the motor housing with the inner circumference of the rotary post. A pivot movement of the door then takes place through the at least one arm which is arranged at the rotary post and by which the rotary post is connected with the door leaf.

If the rotary element is not fixed, then the rotary post freely rotates and consequently in the case of emergency the door leaf can be manually transferred from the closed setting to the open setting.

Specifically, a locking device is provided for fixing the rotary element and here, particularly, the pinion. The locking device is provided in, especially, the upper region of the door portal, wherein the locking device comprises in detail a pivot lever which is mounted to be rotatable about an axle and which comprises a fixing element able to be brought into engagement with the rotary element. In this regard the fixing element has, in particular, a toothing when the rotary element similarly has the form of a pinion. To that extent, the fixing element is arranged at the pivot lever to be non-rotatable.

A lever arrangement is provided for actuating the pivot lever. The pivot lever is of approximately U-shaped construction in plan view, wherein the pivot lever is pivotably mounted in the region of the end of one limb thereof by an axle in a housing and wherein the lever arrangement is arranged in the region of the end of the other limb in order to bring the pivot lever together with the fixing element into or out of engagement with the rotary element. In this regard, the lever arrangement comprises an angled lever which is similarly pivotably mounted in the housing. This angled lever is disposed in pivotable connection with a further lever, the so-termed actuating lever, wherein on actuation of this actuating lever by the angled lever the pivot lever is, as already mentioned, able to be brought together with the fixing element arranged thereon into or out of engagement by—in particular, a toothing—with the rotary element, for example a pinion. The actuating lever is pivotably mounted in the housing. As already mentioned, the housing is, for reception of the locking device, arranged in the head area of the rotary post in the region of the mounting of the rotary post in the door portal. The actuating lever itself projects out of the housing and to that extent can be actuated from outside.

BRIEF DESCRIPTION OF THE DRAWINGS

An exemplifying embodiment of the invention is explained in more detail in the following by way of example with reference to the drawings.

In said drawing.

DETAILED DESCRIPTION OF THE PREFERRED EMBODIMENTS

Figure 1:
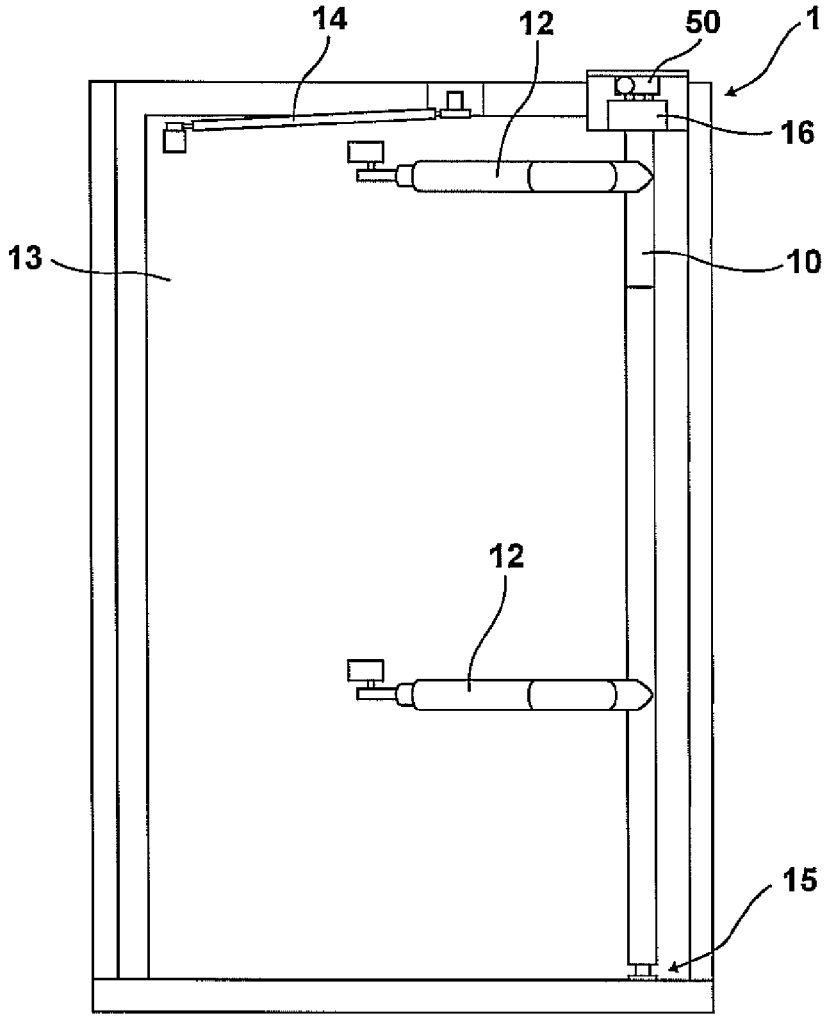
FIG. 1 schematically shows a detail from the door portal of a vehicle with a rotary post, which is seated in the door portal, with pivot arms to which the door leaf is articulated.
Figure 2:
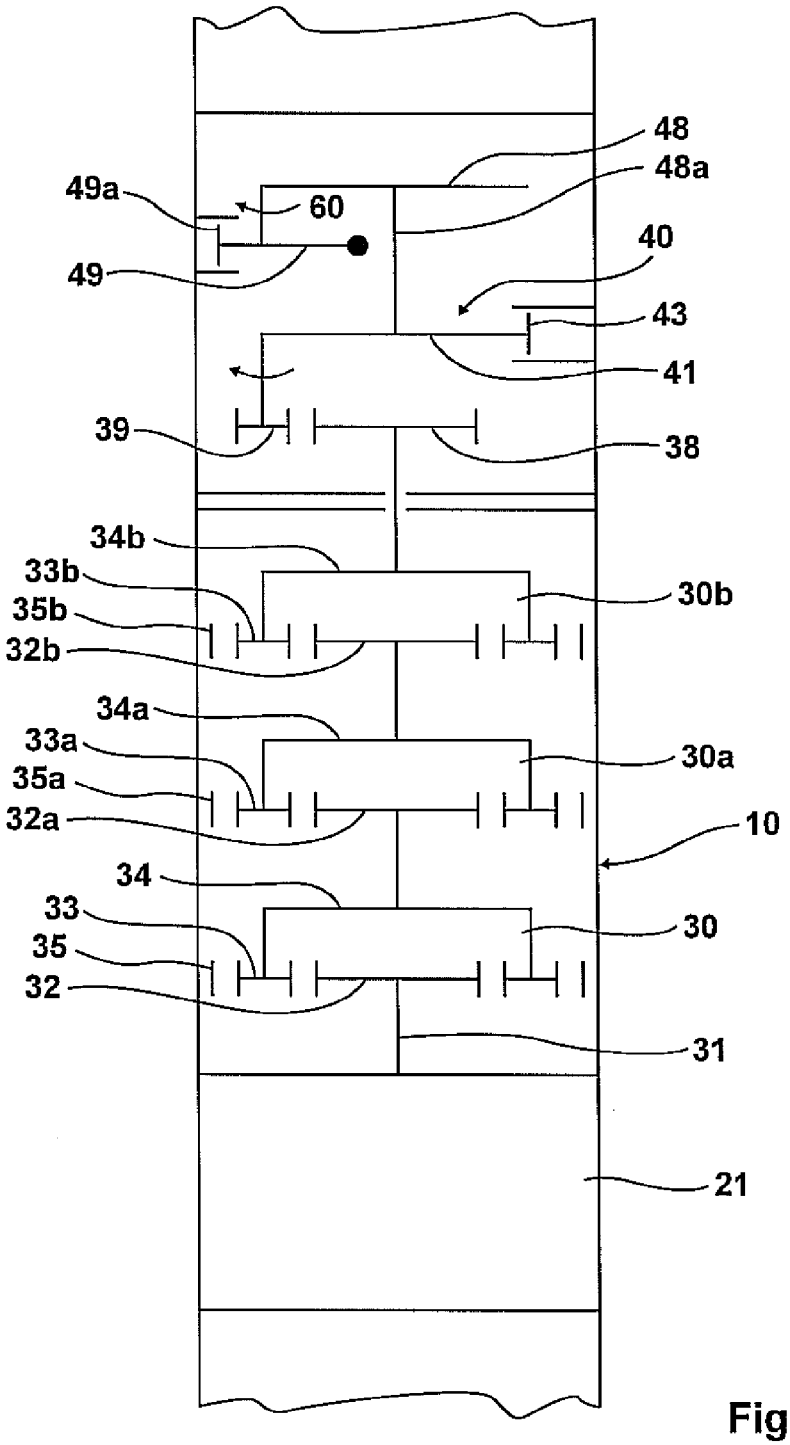
FIG. 2 schematically shows the construction of the rotary post, wherein arranged in the rotary post are the motor as well as three transmission stages and, following thereon, a housing with the locking device.

In the illustration according to FIG. 1 the door portal is denoted by 1. Disposed in the door portal 1 is the rotary post, which is denoted by 10. The rotary post 10 has two mutually spaced-apart pivot arms 12 by which the rotary post 10 is connected with the door leaf 13. In addition, a guide arm 14 is arranged at the door leaf in connection with the door portal 1. The rotary post 10 is rotatably mounted at the lower end (arrow 15) in the portal 1. Disposed at the upper end of the rotary post 10 is a further bearing 16 by which the rotary post 10 is similarly rotatably mounted in the door portal 1 at the upper end. As evident from the illustration according to FIG. 2, the rotary post 10 has the electric motor 21. The electric motor 21 is fixedly connected by way of its housing with the inner circumferential surface of the rotary post 10. Three planetary transmission stages 30, 30*a*, 30*b* providing a step down in speed of the motor shaft 31 are arranged downstream of the motor 21. For this purpose the motor shaft 31 has a sun wheel 32 at the upper end, wherein at least three planet wheels 33 carried by the pinion cage 34 mesh with the sun wheel 32. The rotary post 10 has an internal toothing 35 at the inside in the region of the planet wheels 33 and thus functions as a ring gear so that the planets 33 mesh with the internal toothing 35. The further planetary stages 30, 30*a*, 30*b* provide a further step down in the rotational speed of the shaft 31. The construction of the two succeeding planetary transmission stages 30*a*, 30*b* is identical with the afore-described planetary stage 30, for which reason the reference numerals were selected to be the same but with the letters a and b. A further sun wheel 38, which is constructed as a free rotary element, continues on from the pinion cage 34*b*. This rotary element 38 is fixable by the fixing element 39. The fixing element 39 is part of a locking device 40, the essential component of which is a pivot lever 41, wherein the pivot lever 41 has the fixing element 39. On pivotation of the pivot lever 41 the fixing element 39, which has, in particular, a toothing, is brought into engagement with the rotary element 38, which is constructed as, specifically, a pinion. If the rotary element 38 is locked by the fixing element 39, then the downstream pinion cages 34*b*, 34*a* and 34 are blocked in their rotation. The consequence thereof is that during operation of the motor 21 the motor shaft 31 is similarly fixed, as a result of which the motor 21 sets, by way of its housing, the rotary post 10 into rotation and to that extent provides pivotation of the door leaf 13.

Figure 3:
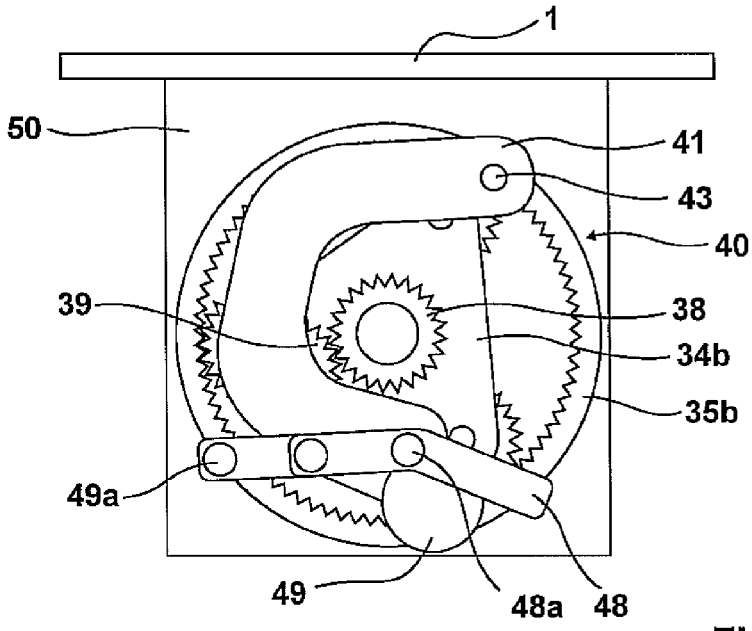
FIG. 3 shows the locking device in a plan view in engagement setting.
Figure 4:
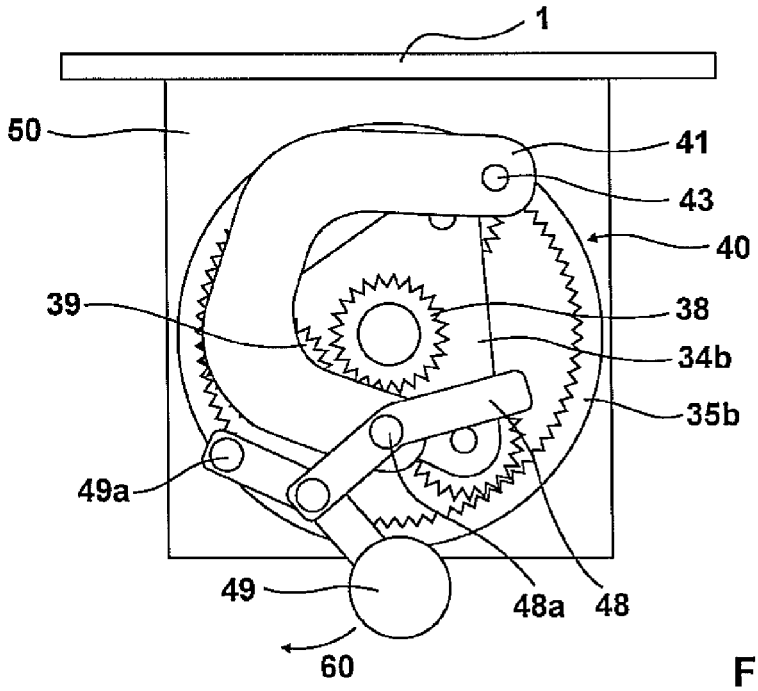
FIG. 4 shows an illustration according to FIG. 3, wherein the locking device is not disposed in the engagement setting.

If the fixing element 39 is not disposed in engagement with the rotary element 38 then the door leaf can be manually brought into an open setting. The construction of the locking device is evident in detail from FIGS. 3 and 4. The locking device 40 is located in a housing 50 which is arranged at the upper end of the rotary post at the portal 1. The pivot lever, which is denoted by 41, is in pivotable connection by an axle 43 with the housing 50. The pivot lever 41 has the fixing element 39, wherein the fixing element 39 in the present case is provided with a toothing. The fixing element 39 can be brought into engagement with the rotary element 38, which has the function of a sun wheel as is apparent in the view of FIG. 2. This sun wheel or rotary element 38 is disposed in rigid connection with the pinion cage 34*b*, so that when the fixing element 39 is brought by the pivot lever 41 into engagement with the pinion 38, the pinion or rotary element 38 is firmly held, thus non-rotatable. Provided for pivotation of the pivot lever 41 is an angle lever 48 which is rotatably mounted on the pivot lever 41 by the axle 48*a*. The actuating lever 49, which is pivotably mounted in the housing by the axle 49*a*, is disposed at the end of the angle lever 48. It can be seen that the fixing element 39 can be brought out of engagement with the pinion 38 when the actuating lever 49 is pivoted in the direction of the arrow 60.

The invention claimed is:

1. Door drive for a swing door of a passenger transport vehicle, comprising:

a rotary post, which is disposed on the vehicle, with at least one swing arm that engages with a door leaf, wherein an electric motor has a housing disposed in the rotary post, wherein the housing of the electric motor is connected with an inner circumferential surface of the rotary post, wherein at least one planetary transmission stage is provided within the rotary post for stepping down a rotational speed of the motor and wherein a pinion cage of the at least one planetary transmission stage has a rotary element that is fixable by way of a stop element, which stop element comprises a swing lever rotatably mounted about an axis which has a fixing element that engages with and disengages with the rotary element.

2. Door drive according to claim 1, wherein the rotary element is a fixable pinion.

3. Door drive according to claim 1, characterised in that the vehicle has a door portal, the rotary post being mounted in the door portal.

4. Door drive according to claim 1, characterised in that the at least one planetary transmission stage includes a plurality of plants and the rotary post has an internal toothing for the planets of the at least one planetary transmission stage.

5. Door drive according to claim 1, characterised in that the fixing element has a toothing.

6. Door drive according to claim 5, characterised in that the pivot lever is formed to be U-shaped so as to define a first and a second limb, wherein in the region of an end of said first limb it is pivotably mounted by the axle in a housing, and wherein a lever arrangement is provided so as to engage the second limb, said lever arrangement operating to bring the pivot lever, together with the fixing element, into or out of engagement with the rotary element.

7. Door drive according to claim 6, characterised in that the housing is arranged at an upper end of the rotary post at the portal of the door opening.

8. Door drive according to claim 6, characterised in that the lever arrangement comprises an actuating lever which projects out of the housing so that the rotary element is fixable from outside by the actuating lever.

9. A door drive for a swing door of a passenger transport vehicle, said door drive comprising:

a rotary post, which is disposed on the vehicle, said rotary post having at least one pivot arm that engages with a door leaf, wherein a motor is arranged in the rotary post and is connected with the rotary post, wherein at least one planetary transmission stage, having a pinion cage, is provided for stepping down a rotational speed of the motor and wherein the pinion cage of the at least one planetary transmission stage comprises a rotary element;

said door drive further including a locking device for selectably fixing the rotation of said rotary element, said locking device comprising a pivot lever which is mounted so as to be rotatable about an axle, said pivot lever including a fixing element, comprising a toothing, wherein said fixing element is operable to engage said rotary element, said pivot lever being U-shaped so as to define a first and a second limb, wherein an end of said first limb is pivotably mounted by the axle in a housing, and wherein a lever arrangement is provided so as to engage the second limb, said lever arrangement operating to bring the pivot lever, together with the fixing element, into or out of engagement with the rotary element.

10. A door drive according to claim 9, wherein the housing is arranged at an upper end of the rotary post at the portal of the door opening.

11. A door drive according to claim 9, wherein the lever arrangement comprises an actuating lever which projects out of the housing so that the rotary element is fixable from outside by the actuating lever.

* * * * *